US006601630B2

(12) United States Patent
Kang

(10) Patent No.: US 6,601,630 B2
(45) Date of Patent: Aug. 5, 2003

(54) TAPE ATTACHING DEVICE OF CAR DOOR SASH

(75) Inventor: Won Gu Kang, Taegu (KR)

(73) Assignees: Kwangsung Corporation Ltd., Ansan (KR); Hyundai Printec Co., Ltd., Taegu (KR)

( * ) Notice: Subject to any disclaimer, the term of this patent is extended or adjusted under 35 U.S.C. 154(b) by 84 days.

(21) Appl. No.: 09/984,375

(22) Filed: Oct. 30, 2001

(65) Prior Publication Data

US 2002/0056525 A1 May 16, 2002

(30) Foreign Application Priority Data

Nov. 13, 2000 (KR) ..... 2000-67038

(51) Int. Cl.[7] ..... B32B 31/00
(52) U.S. Cl. ..... 156/574; 156/71
(58) Field of Search ..... 156/71, 574, 577, 156/579

(56) References Cited

U.S. PATENT DOCUMENTS 4,075,053 A * 2/1978 Adams ..... 156/391
5,820,725 A * 10/1998 Maeda et al. ..... 156/391
6,508,287 B1 * 1/2003 Shinozaki et al. ..... 156/391

FOREIGN PATENT DOCUMENTS

JP 2000-118322 * 4/2000
JP 2001-171570 * 6/2001
WO WO 88/10182 * 12/1988 ..... 156/579
WO WO 01/07313 * 2/2001
WO WO 01/10703 * 2/2001

* cited by examiner

*Primary Examiner*—Mark A. Osele
(74) *Attorney, Agent, or Firm*—Jacobson Holman PLLC

(57) ABSTRACT

The present invention relates to a tape attaching device used in attaching a tape to a car door sash, instead of painting. Tape attaching device comprises a drum block 2 having pressure drums 4, 6 and guide bars 8, 10, a drum cap 12 for adjusting the length of the pressure drums 4, 6 and guide bars 8, 10, an inner roller block 16 having a plurality of inner rollers 18 facing the pressure drums 4, 6 and mounted to a block housing 14 together with the drum block 2 so as for space to be adjusted, a slide support 22 mounted so as for space to be adjusted in the same direction as that of the inner roller block 16, and an outer roller block 26 mounted to the slide support 22 so as for height to be adjusted and having a plurality of outer rollers 24. It can apply to all kinds of car by simply adjusting the space between the pressure drums 4, 6 and inner and outer rollers 18, 24 and the height of outer rollers 24 according to the width and sectional shape of attaching surface of door sash portion 50. Further, smooth operation can be achieved without causing damage to and wear of contact surface since the inner and outer rollers 18, 24 as well as the pressure drums 4, 6 comes into perfectly rolling contact with the door sash portion 50.

5 Claims, 3 Drawing Sheets

TAPE ATTACHING DEVICE OF CAR DOOR SASH

BACKGROUND OF THE INVENTION

The present invention relates to a tape attaching device used in attaching a tape to a car door sash, instead of painting.

Representative prior arts related to an attaching device devised to attach a tape to a car door sash include the Korean Patents No. 98-63283 and 99-64839. For these patents, a tape can be prevented from being damaged because they have flexibility enough to cope with the shape of the surface of a car door sash to which a tape will be attached. It has been pointed out, however, that they have some problems such as incapability of coping with changes in the shape of door sash portion, severe damage or wear of sash and rollers, and unsmooth sliding.

Patent No. 98-63283 states that a sliding block having pressure rollers and opposite to an end block having positioning rollers is elastically supported by a coil spring, so that the device can cope with changes in the shape of sash surface to which a tape will be attached. However, it cannot apply to the different kind of cars with a different basic shape of the sash portion, except the same kind of cars with a similar basic shape of the sash portion. For this reason a separate attaching device for a different kind of car is needed.

Further, if the elastic force of the coil spring supporting the sliding block is weak, the sliding block may be deviated from a specific position where a proper space between it and the end block is maintained. In this case, an adhesive tape may be attached to a wrong position. Too strong elastic force of the coil spring may interfere with the rotation of the rollers.

As shown in FIG. 3, the sash portion is in contact with the bottom of the pressure rollers and positioning rollers parallel to the pressure drums, and a pressure is working to bring the attaching surface into close contact with the pressure drums. If in this state the attaching device is slid straight or three-dimensionally along the sash portion, the rotary direction of the rollers and lengthwise direction of the sash portion are forced out of alignment with each other. In that case, the sash portion will be damaged, and quick wear of the rollers in contact with the sash portion will shorten its service life. In addition, space between the rollers and the pressure drums becomes wide, so that the pressure will not work properly. Accordingly air bubbles may occur when attaching a tape, and resultingly an increase in friction coefficient will lead to no smooth operation.

The device according to Patent No. 99-64839 is also designed to cope with changes in width or thickness of contact surface of the sash portion by adjusting the length of the rollers and height of the guide member facing the portion pressing a tape. Likewise, it cannot apply to the different kind of cars with a different basic shape of the sash portion, except the same kind of cars with a similar basic shape of the sash portion. For this reason a separate attaching device for a different kind of car is needed.

For the device, the attaching surface of the door sash portion is brought into contact in a state of being held between the rollers and plate pressure member. This construction will cause damage of the pressure member and the sash portion and wear of the pressure member at the time of sliding for attaching a tape. Resultingly space from the rollers becomes irregular and attaching defects will occur. In addition, an increase in friction coefficient due to sliding contact will lead to no smooth operation.

SUMMARY OF THE INVENTION

It is an object of the present invention to provide a tape attaching device that can cope with changes of the basic shape of a door sash portion of each kind of car through simple adjustment and achieve smooth operation without damage of a sash portion and wear of rollers during movement for attaching a tape.

Further, it is an another object of the present invention to provide a tape attaching device that can properly cope with changes of the inclination angle the body of the sash portion has from the surface to which a tape will be attached and has a pressure drums that are able to give minimum pressure required to attach a tape even though no pressure is working, so that attaching defects due to lowered pressure and occurrence of air bubble resulting therefrom can be prevented.

To achieve the above-described objects, a tape attaching device according to the present invention comprises pressure drums and guide bars fixed perpendicularly to a drum block, a drum cap for adjusting the exposed length of the pressure drums and guide bars, an inner roller block mounted adjustably to a block housing together with the drum block and having a plurality of inner rollers facing the pressure drums, an outer roller block connected to the inner roller block through a slide support so as to be slided up and down from the slide support for adjustment and having a plurality of outer rollers, and a plurality of adjusting bolts having adjusting means for adjusting space between each block, drum cap and slide support or their heights.

Basically the pressure drums have soft synthetic resin layers in their outside. However, they may be so constructed that they have magnets inside of the soft synthetic resin layer, so that magnetic force can work when they come into contact with the door sash portion. It is desirable that the outer surface of the inner rollers, which come into contact with the inclined surface of the door sash portion, will be formed in the curved shape so that they can properly cope with different inclination angles according to different kinds of car.

On the other hand, the drum block and inner roller block mounted to the block housing so as to be slided for adjustment are provided for adjustment of space between the pressure drums and inner rollers. It does not matter if any block can be slided for adjustment from the other block that is fixed.

DETAILED DESCRIPTION OF THE PREFERRED EMBODIMENTS

With reference to the accompanying drawings, the present invention will now be described.

Figure 1:
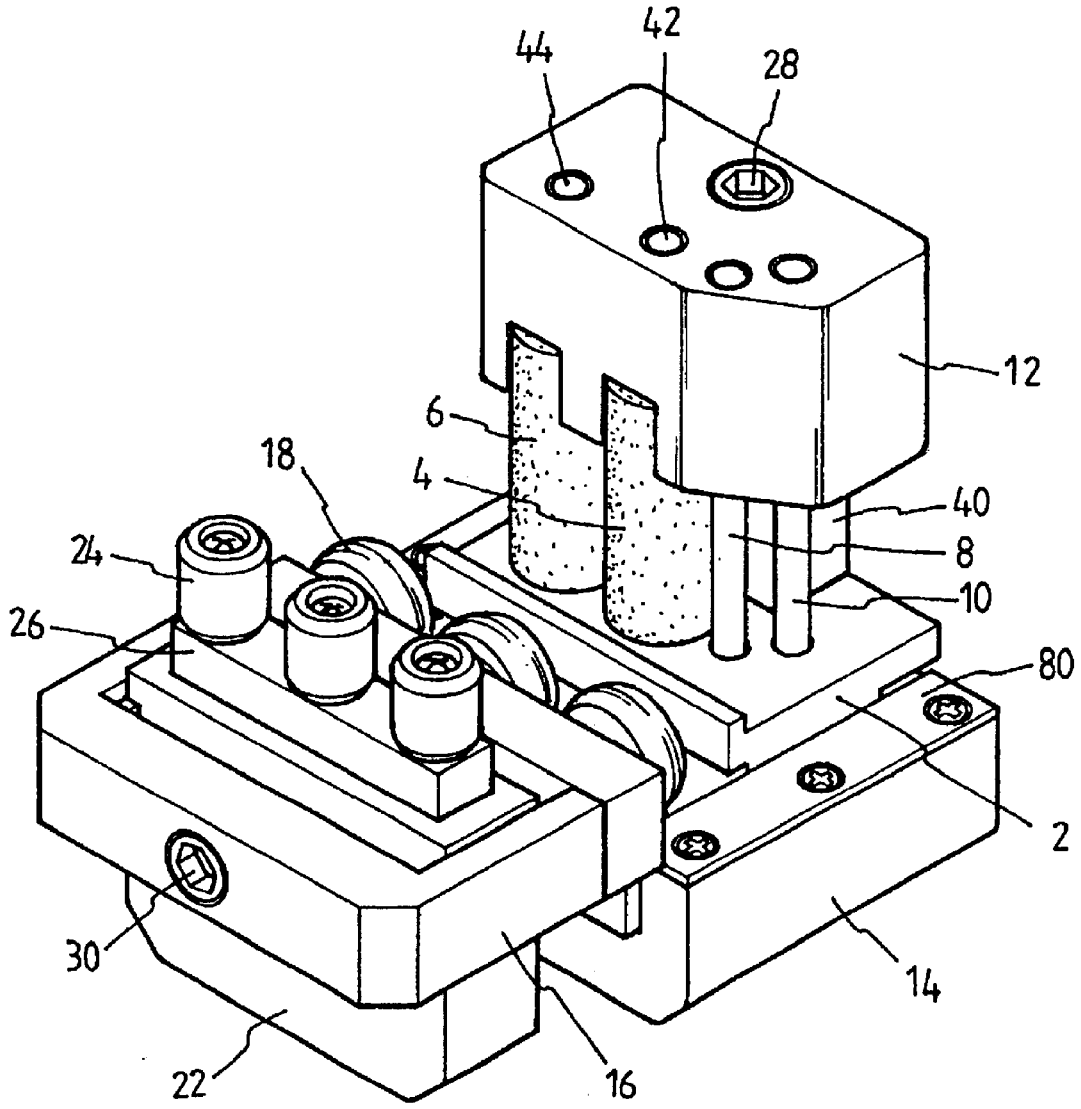
FIG. 1 is an perspective view of a tape attaching device of car door sash according to the present invention.

FIG. 1 is a perspective view showing a tape attaching device of car door sash according to the present invention. The tape attaching device comprises pressure drums 4, 6 and guide bars 8, 10 fixed perpendicularly to a drum block 2, a drum cap 12 for adjusting the length of pressure drums 4, 6 and guide bars 8, 10 to be suitable for the width of an adhesive tape, an inner roller block 16 mounted to a block housing 14 together with drum block 2 so as for space to be adjusted and having a plurality of inner rollers 18, a slide support 22 mounted to inner roller block 16 so as to be adjusted in the same direction, an outer roller block 26 mounted so as for the height to be adjusted from slide support 22 and having a plurality of outer rollers 24 in its outside, and a plurality of adjusting bolts having adjusting means for each block 2, 16, 26, drum cap 12 and slide support 22.

Figure 2:
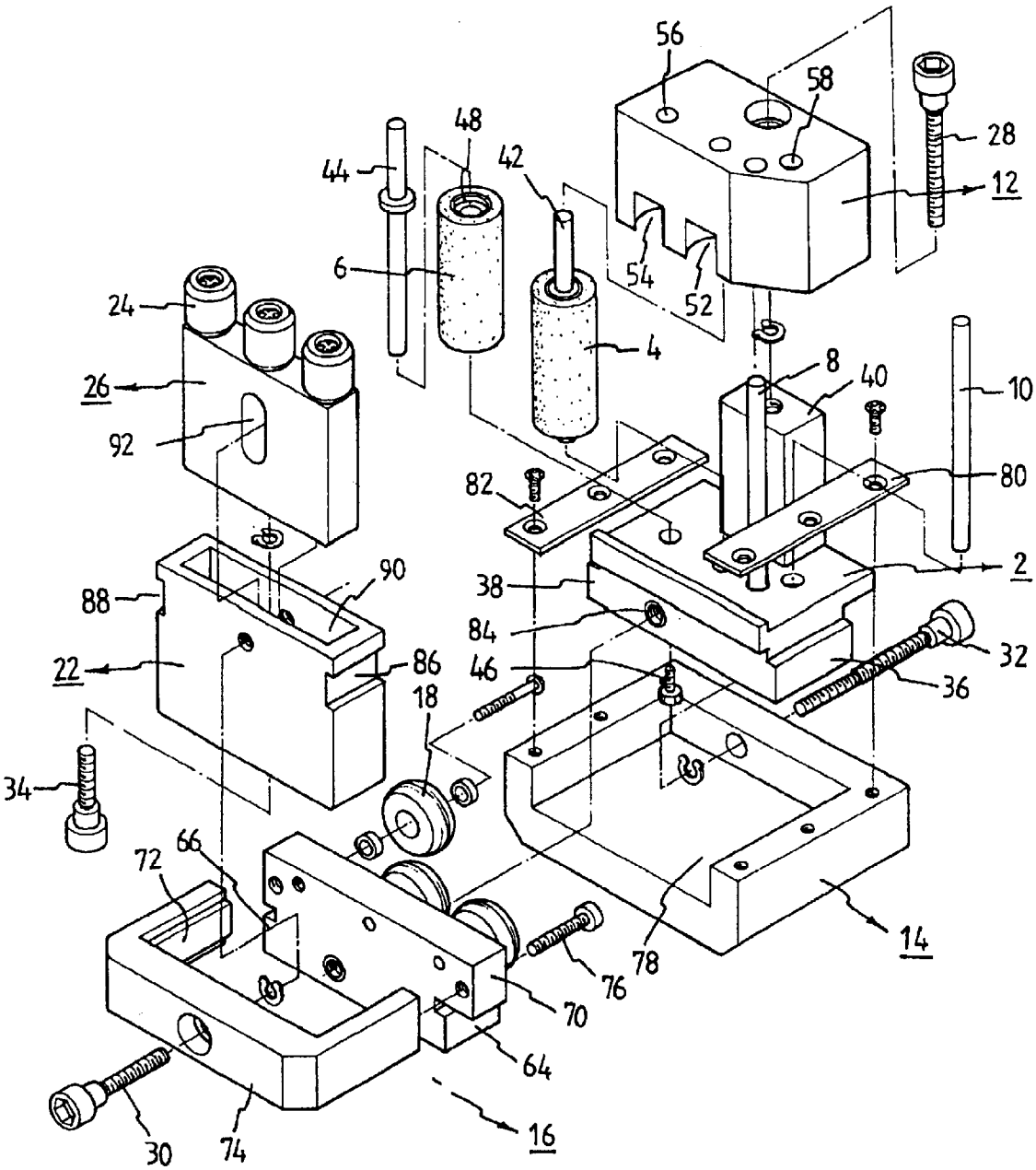
FIG. 2 is an exploded view of a tape attaching device of car door sash according to the present invention.

With reference to FIG. 2, drum block 2 comprises left and right guides 36 and 38 having mounting means for being mounted to block housing 14 and a guide support 40 supporting and guiding drum cap 12, and drum shafts 42, 44 supporting pressure drums 4, 6 and guide bars 8, 10 are fixed perpendicularly by bolts 46 to a plane portion facing drum cap 12.

For pressure drums 4, 6 in the above construction, only ones having soft synthetic resin layer in their outside are suitable for the purpose of the present invention. They may have cylindrical magnets inside of the soft synthetic resin layer, so that magnetic force can work when they come into contact with a door sash portion 50.

On the other hand, drum cap 12 for adjusting the length of pressure drums 4, 6 and guide bars 8, 10 has recessed grooves 52, 54 having larger diameter than pressure drums 4, 6 and mounting holes 56, 58 formed so as for the ends of drum shafts 42, 44 and guide bars 8, 10 to be inserted thereinto smoothly, and a recessed groove 60 for being connected to guide stand 40 of drum block 2. Drum cap 12 is mounted to drum block 2 by an adjusting bolt 28 passing through recessed groove 60. Space between drum cap 12 and drum block 2 is adjusted by fastening or unfastening adjusting bolt 28 so that pressure drums 4, 6 and guide bars 8, 10 can have a length suitable for the width of an adhesive tape. At this time, a space should be secured between drum block 2 and guide stand 40, through which a tape can pass smoothly.

In addition, inner roller block 16 comprises a supporting portion 70 having left and right guides 64, 66 as a means for mounting inner roller block 16 to block housing 14 and a plurality of inner rollers 18, and a guiding portion 74 having guiding projections 72 for guiding slide support 22. Supporting portion 70 and guiding portion 74 are connected to each other by bolts 76 after slide support 77 is connected to guiding portion 74 by an adjusting bolt 30 that is inserted into a screw hole on the outer surface of guiding portion 74 so as to be rotated idly.

Block housing 14 to which drum block 2 and inner roller block 16 are mounted so as for space to be adjusted has a guiding groove 78 and an adjusting bolt 32 which is mounted to a side wall of guiding groove 78. Drum block 2 and inner roller block 16 are mounted loosely by their guides 36, 38, 64, 66 to block housing 14 through guiding groove 78 of block housing 14, and prevented from coming off by slide plates 80, 82. They are also fixed to block housing 14 by stepped adjusting bolt 32. Space between pressure drums 4, 6 and inner rollers 18 is adjusted by fastening or unfastening adjusting bolt 32.

At this time, however, there should be separate screw tubes 84 as female screws that have been inserted forcedly into fixing holes drum block 2 and inner roller block 16 have in order to mount drum block 2 and inner roller block 16 to block housing 14.

Any structure in which space between pressure drums 4, 6 and inner rollers 18 can be adjusted by fastening or unfastening adjusting bolt can suffice for the purpose of the present invention. Therefore, the present invention does not need a structure in which two blocks should be adjusted together. If one block screwed to the other fixed block by adjusting bolt can be slid for adjustment of space, such structure may be included in the scope of the present invention.

Slide support 22 has left and right giving grooves 86, 88, an inserting groove 90 formed deeply in its inside, and an adjusting bolt 34 that is fastened to a side wall of inserting groove 90 so as to be rotated idly. Slide support 22 is slided into guiding portion 74 by means of its left and right guiding grooves 86, 88 and guiding projections 72 of guiding portion, and slide support 22 and guiding portion 74 are screwed to each other by adjusting bolt 30 before supporting portion 70 and guiding portion 74 are connected to each other. Space between pressure drums 4, 6 and outer roller is adjusted by fastening or unfastening adjusting bolt 30.

Outer roller block 26 that is of plate type and mounted to slide support 22 so as for height to be adjusted has a plurality of outer rollers 24 in its outside and a long hole 92 formed in its central part to avoid interference with adjusting bolt 30 inner roller block 16 has. Before slide support 22 is screwed to inner roller block 16 by adjusting bolt 30, outer roller block 26 is inserted deeply into inserting groove 90 of slide support. Then, it is screwed to slide support 22 by adjusting bolt 34 slide support 22 has, so that its height can be adjusted by fastening and unfastening adjusting bolt 34.

Figure 3:
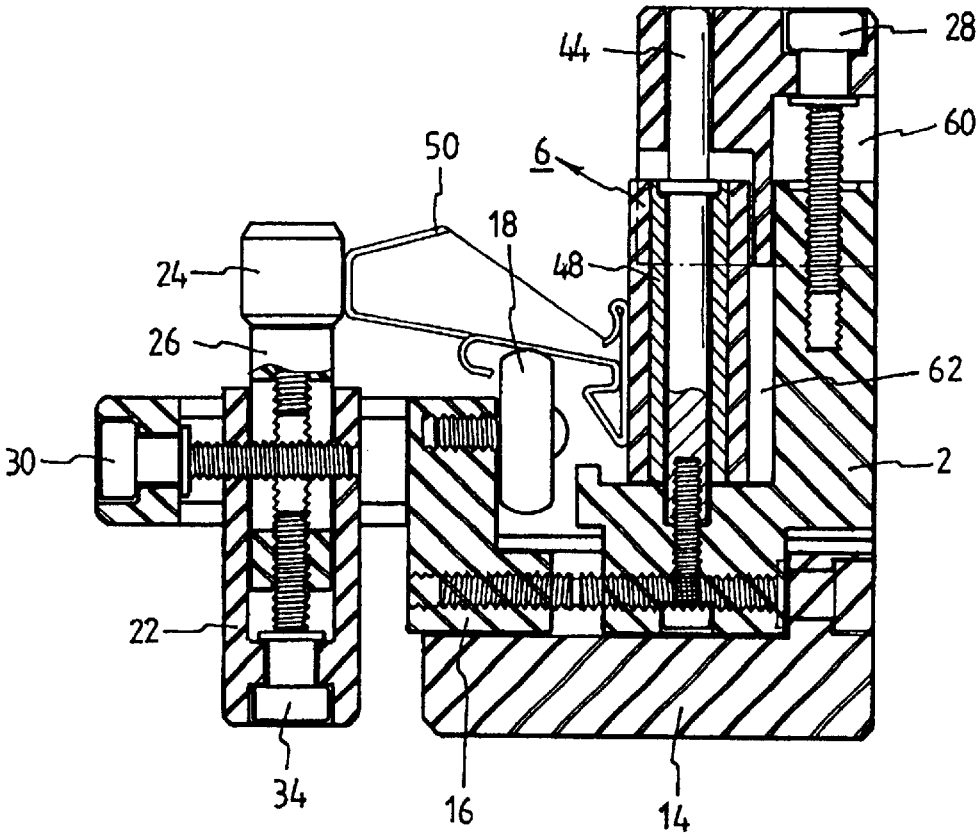
FIG. 3 is a cross-sectional view of a tape attaching device of car door sash according to the present invention.

FIG. 3 shows a cross-section of a tape attaching device according to the present invention. The tape attaching device is designed to adjust the length of pressure drums 4, 6 and guide bars 8, 10, space between pressure drums 4, 6 and inner and outer rollers 18, 24, and height of outer rollers 24 according to the width and shape of attaching surface of door sash portion to which a tape will be attached. In the case that the tape attaching device is to be used in the same kind of car, only initial adjustment enables it to be used for a long time without further adjustment.

That is, once a specific width of a tape is given according to the width of attaching surface of a door sash portion 50, the exposed portions of pressure drums 4, 6 and guide bars 8, 10 will have a length suitable for the given width of a tape by adjusting the space between drum block 2 and drum cap 12 by means of space of recessed grooves 52, 54, 60 and adjusting bolt 28.

In the case of change of an inclination angle the body of door sash portion 50 has from its attaching surface, inner rollers 18 will have a position that can come into contact with the inclined surface by adjusting the space between pressure drums 4, 6 and inner rollers 18 by means of adjusting bolt 32 block housing 14 has. Further, the outer surface of inner rollers 18 is formed in the curved shape so that they can properly cope with various inclination angles.

The larger the angle of inclination from the attaching surface, the larger the door sash portion deviates. In this case, outer rollers 24 should be adjusted to be flush with door sash portion 50 by means of adjusting bolt 34 slide support 22 has, and subsequently the space between outer rollers 24 and pressure drums 4, 6 should be adjusted to be same as that of door sash portion 50 by means of adjusting bolt 30 inner roller block has.

The tape attaching process is carried out as follows. A base paper of tape is immediately discharged along guide bars 8, 10 by passing the end of tape through space 62 formed between pressure drums 4, 6 and guide stand 40. Tape is attached first to the starting position of attaching surface of door sash portion 50 by drawing tape along pressure drum 4 in the feeding direction. Then, door sash portion 50 is put and held between pressure drum 4, 6 and inner and outer rollers 24. Lastly tape is attached to the attaching surface of door sash portion by holding block housing 14 and moving the tape attaching device along the straight or three-dimensionally curved part of door sash portion 50.

During the above process, tape is positioned by space between drum block 2 and drum cap 12. Therefore, tape is correctly attached to the attaching surface of door sash portion 50.

Since inner and outer rollers 18, 24 as well as pressure drums coming into close contact with door sash portion 50 are rolled along the outer surface of door sash portion 50, the tape attaching device can slide smoothly along door sash portion 50.

Basically pressure drums 4, 6 are brought into close contact with door sash portion 50 by space between them and inner and outer rollers 18, 24. If pressure drums 4, 6 have magnets 48 inside of their soft synthetic resin layers, strong magnetic force is generated when pressure drums 4, 6 come into contact with metallic door sash portion 50 and enables tape to be attached to attaching surface normally without forced pressure. Although attaching process is performed with space between pressure drums 4, 6 and inner and outer rollers 18, 24 apart, minimum pressure required for attaching is given by magnets 48. Therefore, no attaching defects occur due to lowered pressure.

A tape attaching device according to the present invention can cope properly with changes of the width and basic shape of attaching surface of door sash portion 50 of each kind of car and of the inclination angles the body of door sash portion has from the attaching surface by simply adjusting the length of pressure drums 4, 6 and guide bars 8, 10, space between pressure drums 4, 6 and inner and outer rollers 18, 24, and height of outer rollers 24. Since it can apply to all kinds of car just with simple adjustment, it will greatly contribute to reduction in manufacturing cost and effective inventory management of parts.

If inner rollers 18 cope properly with change of an inclination angle the body of door sash portion 50 has and comes into stable contact with the outer surface of the body, and if pressure drums 4, 6 have minimum pressure which is generated from magnets 48 and required for attaching, good attaching can be achieved without defect even when space between them and inner and outer rollers 18, 24 changes.

Since pressure drums 4, 6 and inner and outer rollers 18, 24 are rolled along door sash portion by moving the tape attaching device along door sash portion, damage of door sash portion 50 can be prevented and long service life of inner and outer rollers 18, 24 can be obtained. Especially smooth operation without frictional resistance.

What is claimed is:

1. A tape attaching device of car door sash according to the present invention comprises a drum block 2 supporting and fixing pressure drums 4, 6 and guide bars 8, 10, a drum cap 12 mounted to a guide stand 40 of said drum block 2 from the top of said pressure drums 4, 6 and guide bars 8, 10 so as for its height to be adjusted, an inner roller block 16 mounted to a block housing 14 together with said drum block 2 so as for space to be adjusted and having a plurality of inner rollers 18 facing said pressure drums 4, 6, a slide support 22 mounted to a guiding portion 74 of said inner roller block 16 so as to be adjustable in the same direction as that of said inner roller block 16, and an outer roller block 26 mounted to said slide support 22 so as for height to be adjusted and having a plurality of outer rollers 24 on its outside.

2. A tape attaching device of car door sash according to claim 1, wherein as means for adjusting said blocks 2, 16, 26, said drum cap 12 and said slide support 22, adjusting bolts 28, 30, 32, 34 are mounted to corresponding positions so as to be rotated idly.

3. A tape attaching device of car door sash according to claim 1, wherein said drum caps 12 have recessed grooves 52, 54, 60 which are used in mounting said drums 4, 6 and said guide stand 40 of said drum block 2.

4. A tape attaching device of car door sash according to claims 1 and 3, wherein said pressure drums 4, 6 have magnets 48 in their insides.

5. A tape attaching device of car door sash according to claim 1, wherein a plurality of said inner rollers 18 have curved outer surfaces.

* * * * *